US010450172B1

(12) United States Patent
Shaul

(10) Patent No.: US 10,450,172 B1
(45) Date of Patent: Oct. 22, 2019

(54) FAIRLEAD ASSEMBLY FOR A VEHICLE MOUNTED WINCH

(71) Applicant: Torrey Miles Shaul, Estacada, OR (US)

(72) Inventor: Torrey Miles Shaul, Estacada, OR (US)

( * ) Notice: Subject to any disclaimer, the term of this patent is extended or adjusted under 35 U.S.C. 154(b) by 0 days.

(21) Appl. No.: 16/260,200

(22) Filed: Jan. 29, 2019

Related U.S. Application Data

(60) Provisional application No. 62/627,405, filed on Feb. 7, 2018.

(51) Int. Cl.
*B66D 1/36* (2006.01)

(52) U.S. Cl.
CPC ..... *B66D 1/36* (2013.01); *B66D 2700/0191* (2013.01)

(58) Field of Classification Search
CPC ..... B66D 1/36; B66D 2700/0191
See application file for complete search history.

(56) References Cited

U.S. PATENT DOCUMENTS 458,855 A * 9/1891 Meinzer ..... B66D 1/36 254/395
817,553 A * 4/1906 Prink ..... B66D 1/36 254/397
1,092,714 A 4/1914 Holmes
1,525,837 A * 2/1925 Walker ..... B60S 5/04 242/157 R
1,598,802 A * 9/1926 Brown ..... B66D 1/36 254/397
1,599,666 A * 9/1926 Manley ..... B66D 3/06 254/395
2,422,353 A * 6/1947 Hitt ..... B65H 75/4402 242/157 R
2,483,760 A * 10/1949 Duncan ..... B65H 57/14 254/395
2,946,559 A * 7/1960 Pickett ..... B65H 57/14 254/134.3 PA
2,949,279 A * 8/1960 Miller ..... F16H 7/18 254/397
3,070,355 A * 12/1962 Wyatt ..... B63B 21/10 254/134.3 R
3,098,639 A * 7/1963 Bromberg ..... B65H 57/14 254/396

(Continued)

*Primary Examiner* — Michael E Gallion
(74) *Attorney, Agent, or Firm* — Goldstein Law Offices, P.C.

(57) ABSTRACT

A fairlead assembly for use with a vehicle-mounted winch and cable, the fairlead assembly is adapted to guide and control the cable as it is spooled in or out by the winch. The fairlead assembly is attached to the vehicle, and comprises a pair of horizontal rollers positioned in parallel and separated by a cable guide space, along with a pair of vertical rollers positioned to the right and left of the cable guide space. The horizontal and vertical rollers control the vertical and horizontal motion of the cable within the cable guide space. The vertical and horizontal rollers may have coplanar central axes, allowing the fairlead assembly to have a reduced profile. The vertical rollers may also each comprise a cable control groove to guide and control the horizontal and vertical motion of the cable when the winch and cable are employed to execute a sideways pull.

11 Claims, 8 Drawing Sheets

(56) References Cited

U.S. PATENT DOCUMENTS

| | | | | | |
|---|---|---|---|---|---|
| 3,708,152 | A * | 1/1973 | Bulin | B66D 1/36 | 254/327 |
| 4,296,917 | A * | 10/1981 | Day | B66D 1/36 | 254/327 |
| 5,573,226 | A * | 11/1996 | Smith | B65H 57/14 | 226/196.1 |
| 5,927,693 | A | 7/1999 | Hackl | | |
| 6,631,886 | B1 * | 10/2003 | Caudle | B66D 1/36 | 254/327 |
| 6,729,606 | B1 * | 5/2004 | Durin | B65H 57/14 | 242/615.2 |
| 7,118,094 | B2 | 10/2006 | McDaniel et al. | | |
| 7,896,604 | B1 * | 3/2011 | Donlin | B66D 1/00 | 212/180 |
| 8,052,098 | B1 * | 11/2011 | Kowaleski | E04D 15/00 | 248/237 |
| 8,674,263 | B2 * | 3/2014 | Gelmetti | B23K 9/133 | 219/136 |
| 9,061,861 | B2 | 6/2015 | Grassi | | |
| 9,682,649 | B2 * | 6/2017 | Salter | F21S 43/13 | |
| 9,783,398 | B1 * | 10/2017 | Dartlon | B60P 1/04 | |
| 10,315,894 | B2 * | 6/2019 | Anderson | B66D 1/38 | |
| 2006/0201980 | A1 * | 9/2006 | Koons | B60D 1/07 | 224/511 |
| 2006/0289844 | A1 * | 12/2006 | McFarland | B66D 1/00 | 254/264 |
| 2011/0168961 | A1 * | 7/2011 | Christiansen | B66D 1/36 | 254/327 |
| 2012/0187355 | A1 * | 7/2012 | Mehrkens | A63C 11/10 | 254/222 |
| 2015/0329335 | A1 * | 11/2015 | Azzarelli | B66D 3/006 | 254/323 |

* cited by examiner

FAIRLEAD ASSEMBLY FOR A VEHICLE MOUNTED WINCH

CROSS-REFERENCE TO RELATED APPLICATIONS

This application is a nonprovisional utility application of provisional patent application, Ser. No. 62/627,405 filed in the United States Patent Office on Feb. 7, 2018, claims priority therefrom, and is expressly incorporated herein by reference in its entirety.

TECHNICAL FIELD

The present disclosure relates generally to a fairlead assembly. More particularly, the present disclosure relates to an improved roller fairlead assembly adapted to guide and control a cable attached to a vehicle mounted winch.

BACKGROUND

Off-road vehicles are commonly equipped with a powered winch and cable assembly which allow them to traverse obstacles such as deep mud, steep inclines, and other hazards which would otherwise be too difficult or dangerous for an unassisted vehicle. By attaching the cable to a fixed anchor point such as a tree or even another vehicle, a vehicle with a powered winch can pull itself out of mud or up a steep slope which would ordinarily cause the vehicle to lose traction or become mired. A vehicle with a powered winch may also be used to recover stranded vehicles by pulling them out of hazardous situations.

Vehicles with winches often employ a fairlead in combination with the winch to guide the cable as it is spooled in or out by the winch during a winching operation. Typical fairleads fall into two categories—hawse and roller fairleads. A standard hawse fairlead is a metal plate with a horizontal slot or mouth through which the cable passes. However, contact between the cable and the slot of the hawse can cause friction which can damage or even snap the cable under certain conditions. Roller fairleads provide an alternative to the hawse fairlead, and typically employ two horizontal rollers and two vertical rollers which guide the cable and rotate in order to reduce friction. However, roller fairleads are much bulkier than hawse fairleads, and are configured with the vertical rollers positioned in front of the horizontal rollers. As winches are usually mounted on the front bumper of the vehicle, a roller fairlead with protruding vertical rollers reduces the approach angle of the vehicle by making it more difficult for the vehicle to approach a steep slope. The increased profile of the roller fairlead may result in the roller fairlead contacting or even digging into the slope as the vehicle approaches, preventing the vehicle from climbing the slope and potentially damaging the fairlead, winch, or even the vehicle itself.

Therefore, there is a need for an improved fairlead assembly which repositions the vertical rollers to achieve a compact profile while still providing the advantages of a roller fairlead.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a fairlead assembly adapted for use with a vehicle mounted winch and a cable by guiding and controlling the cable as it is spooled in and out by the winch. Accordingly, the present disclosure provides a fairlead assembly comprising a mounting frame, a pair of vertical rollers, and a pair of horizontal rollers. The fairlead assembly is attached to the vehicle via the mounting frame, the horizontal rollers are attached to the mounting frame in a parallel configuration separated by a cable guide space, while the pair of vertical rollers are positioned to either side of the cable guide space. The cable passes through the cable guide space as it is spooled in or out by the winch, allowing the horizontal rollers to control the vertical motion of the cable, while the vertical rollers control the horizontal motion of the cable as it moves laterally within the cable guide space.

It is another aspect of an example embodiment in the present disclosure to provide a fairlead assembly which has a reduced profile, thereby increasing the approach angle of the vehicle. Accordingly, the horizontal and vertical rollers may be arranged such that each of the horizontal and vertical rollers has a surface which is coplanar with a vertical plane that runs laterally across the fairlead assembly.

It is yet another aspect of an example embodiment in the present disclosure to provide a fairlead assembly which prevents the cable from becoming pinched between the vertical and horizontal rollers. Accordingly, the vertical rollers may have a length which is substantially equal to the height of the cable guide space, and the vertical rollers may further extend inwardly into the cable guide space such that the vertical rollers overlap the horizontal rollers, ensuring there are no gaps within the cable guide space in which the cable may become pinched.

It is a further aspect of an example embodiment in the present disclosure to provide a fairlead assembly which is capable of controlling the vertical motion of the cable as the winch executes a sideways pull. Accordingly, the vertical rollers may each further comprise a cable control groove adapted to partially retain the cable as it bends around the vertical rollers in order to control the vertical motion of the cable.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
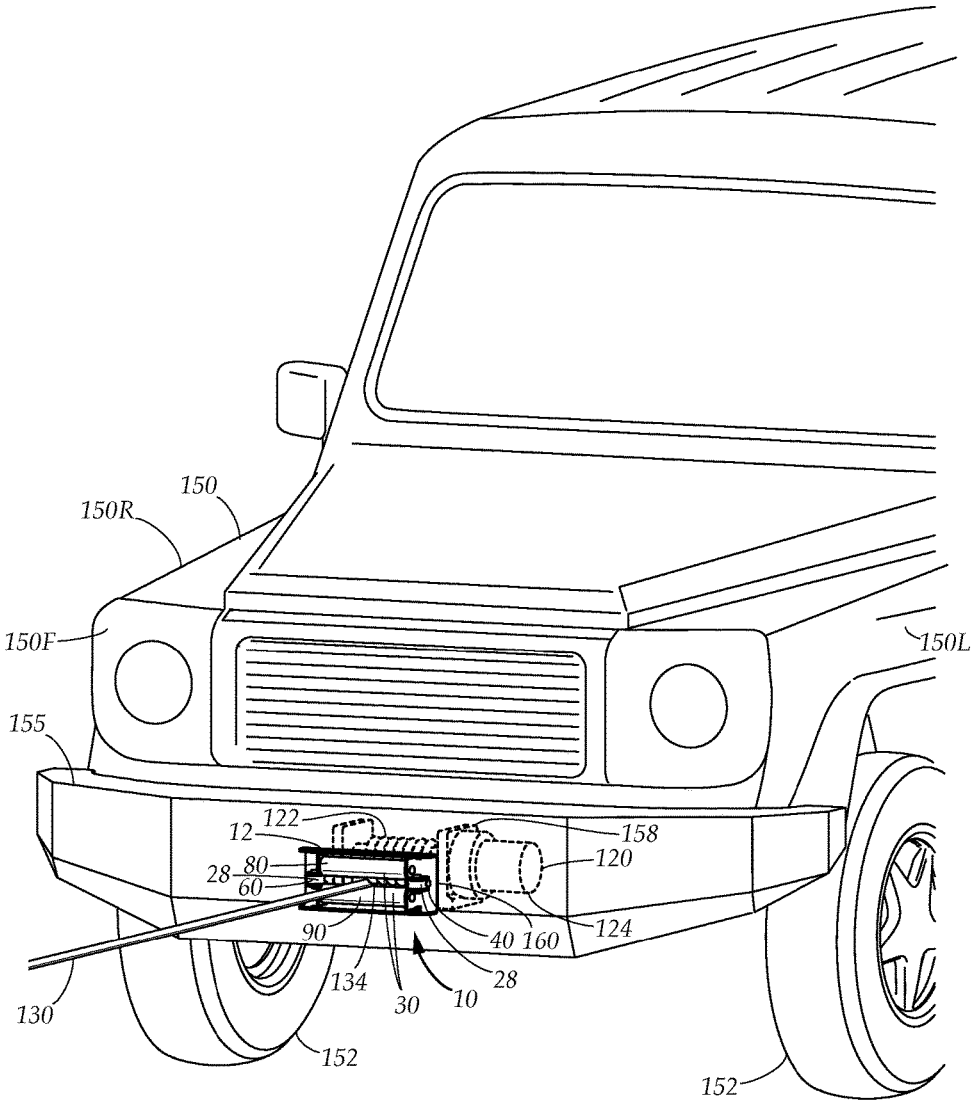
FIG. 1 is diagrammatic perspective view of a fairlead assembly mounted to a vehicle equipped with a winch, in accordance with an embodiment of the present disclosure.

FIG. 1 illustrates a fairlead assembly 10 adapted to operate with a winch 120 and a cable 130 by guiding the vertical and horizontal movement of the cable 130 as it is spooled in or spooled out by the winch 120. In a preferred embodiment, the winch 120 is adapted for use with a vehicle 150 having a front 150F, a plurality of wheels 152, a bumper 155, a winch mounting point 158 to which the winch 120 is secured, and a fairlead mounting point 160 to which the fairlead assembly 10 is attached. The winch mounting point 158 may be positioned on or proximate to the bumper 155, while the fairlead mounting point 160 may be positioned in front of the winch mounting point 158 to allow the cable 130 to pass through the fairlead assembly 10. The winch 120 may comprise a drum 122 around which the cable 130 is spooled, and may further comprise a motor 124 or other mechanism which rotates the drum to spool in or spool out the cable 130. The cable 130 may be formed of synthetic fiber rope, steel cable, or other suitable material. When the winch 120 and cable 130 are in use, the cable 130 may be attached to a fixed anchoring point, such as a tree, and the winch may spool in the cable 130 in order to pull the vehicle 150 towards the fixed anchoring point. Alternatively, the cable 130 may be attached to a towing object, and the winch 120 may spool in the cable 130 to pull the towing object towards the vehicle 150. The winch 120 may also spool out the cable 130 to reduce cable tension or increase the length of cable 130 between the winch and the fixed anchoring point or the towing object. FIG. 1 depicts an exemplary configuration where the winch mounting point 158 is located on the vehicle 150 in a position behind the bumper 155, while the fairlead mounting point 160 is located on the bumper 155, allowing the fairlead assembly 10 to be positioned between the winch 120 and the fixed anchoring point or towing object.

The fairlead assembly 10 comprises a mounting frame 12, and a pair of vertical rollers 28 and a pair of horizontal rollers 30, which are attached to the mounting frame 12 and are adapted to guide the cable 130 by controlling the horizontal and vertical motion of the cable 130. The mounting frame 12 is attached to the vehicle 150 at the fairlead mounting point 160. Each of the vertical and horizontal rollers 28, 30 are preferably cylindrical in shape, and are capable of rotating freely about a central axis passing through each of the vertical and horizontal rollers 28, 30. The pair of vertical rollers 28 comprise a first vertical roller 40 and a second vertical roller 60, while the pair of horizontal rollers 30 comprise an upper horizontal roller 80 and a lower horizontal roller 90. The upper and lower horizontal rollers 80, 90 are positioned in parallel and are separated by a space, while the first and second vertical rollers 40, 60 are oriented parallel to each other and are positioned to the right and left of the space between the upper and lower horizontal rollers 80, 90. This space between the vertical and horizontal rollers 28, 30 corresponds to a cable guide space 134, through which the cable 130 passes as it is spooled in and out by the winch 120. As the cable 130 is spooled in and spooled out within the cable guide space 134, the vertical and horizontal rollers 28, 30 are adapted to rotate, thus reducing the friction between the cable 130 and the fairlead assembly 10 and mitigating wear and tear on the cable 130. Furthermore, the first and second vertical rollers 40, 60 are coplanar with the upper and lower horizontal rollers 80, 90, thus giving the fairlead assembly 10 a significantly reduced profile in comparison with prior art roller fairleads which have vertical rollers positioned in front of the horizontal rollers.

Figure 2A:
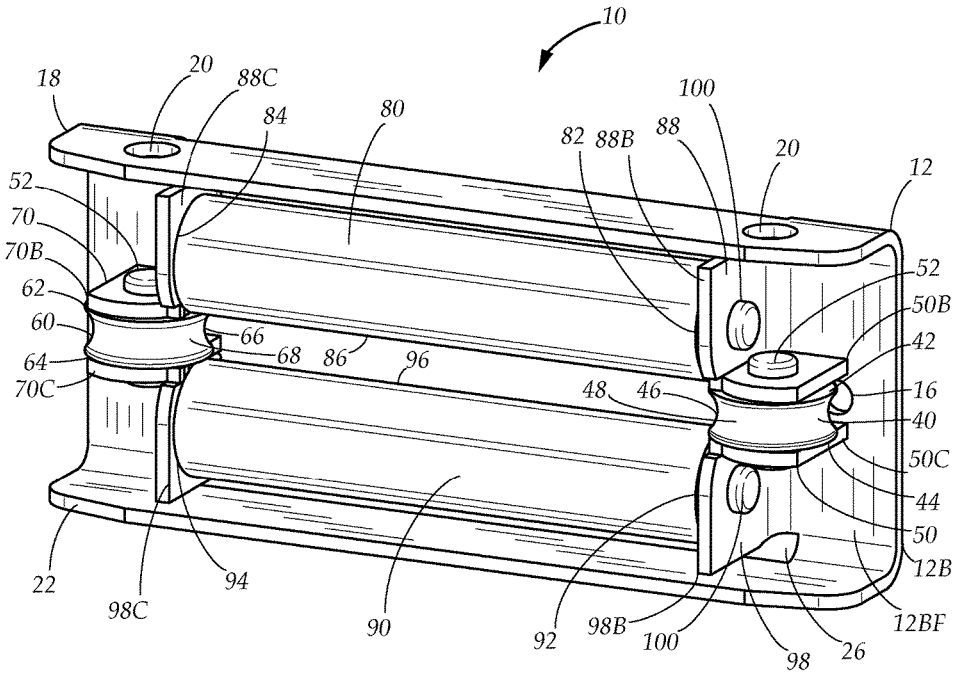
FIG. 2A is a diagrammatic front perspective view of the fairlead assembly, depicting a pair of horizontal rollers and a pair of vertical rollers, in accordance with an embodiment of the present disclosure.

Turning to FIG. 2A, while continuing to refer to FIG. 1, the first vertical roller 40 comprises a first top end 42, a distally positioned first bottom end 44, and a first vertical roller surface 46. The second vertical roller 60 comprises a second top end 62, a distally positioned second bottom end 64, and a second vertical roller surface 66. The upper horizontal roller 80 comprises an upper roller first end 82, a distally positioned upper roller second end 84, and an upper roller surface 86. The lower horizontal roller 90 comprises a lower roller first end 92, a distally positioned lower roller second end 94, and a lower roller surface 96. In a preferred embodiment, each of the first and second vertical rollers 40, 60 and upper and lower horizontal rollers 80, 90 are cylindrical, and each has a central axis. The first and second vertical rollers 40, 60 may each further comprise a vertical shaft 52 passing through the central axis of each vertical roller 40, 60. Similarly, the upper and lower horizontal rollers 80, 90 may each further comprise a horizontal shaft 100 passing through the central axis of each horizontal roller 80, 90.

The fairlead assembly 10 further comprises a first vertical mounting assembly 50, a second vertical mounting assembly 70, an upper horizontal mounting assembly 88, and a lower horizontal mounting assembly 98. The first vertical mounting assembly 50 may comprise a first top bracket 50B and a first bottom bracket 50C bracket positioned opposite to the first top bracket 50B. The first vertical roller 40 is positioned between the first top and bottom brackets 50B, 50C such that the first top end 42 is rotatably attached to the first top bracket 50B and the first bottom end 44 is rotatably attached to the first bottom bracket 50C, allowing the first vertical roller 40 to rotate about its central axis while positioned therebetween. Similarly, the second vertical mounting assembly 70 may comprise a second top bracket 70B and a second bottom bracket 70C positioned opposite to the second top bracket 70B. The second top end 62 and second bottom end 64 of the second vertical roller 60 are rotatably attached to the second top and bottom brackets 70B, 70C respectively, allowing the second vertical roller 60 to rotate about its central axis while positioned between the second top and bottom brackets 70B, 70C. In a preferred embodiment, the vertical shafts 52 of the first and second vertical rollers 40, 60 extend past the first top and bottom ends 42, 44 and the second top and bottom ends 62, 64 to allow the first and second vertical rollers 40, 60 to rotatably attach to the first and second vertical mounting assemblies 50, 70.

The upper horizontal mounting assembly 88 may comprise an upper right bracket 88B and an upper left bracket 88C positioned opposite to the upper right bracket 88B. The upper horizontal roller 80 is positioned between the upper right and left brackets 88B, 88C such that the upper roller first end 82 and the upper roller second end 84 are rotatably attached to the upper right and left brackets 88B, 88C respectively, allowing the upper horizontal roller 80 to rotate about its central axis while positioned therebetween. The lower horizontal mounting assembly 98 may comprise a lower right bracket 98B and a lower left bracket 98C positioned opposite to each other. The lower roller first end 92 and lower roller second end 94 may be rotatably attached to the lower right bracket 98B and lower left bracket 98C respectively, allowing the lower horizontal roller 90 to rotate about its central axis while positioned therebetween. In a manner similar to the vertical shafts 52 of the first and second vertical rollers, the horizontal shafts 100 of the upper and lower horizontal rollers 80, 90 may extend outwards beyond the upper roller first and second ends 82, 84 and the lower roller first and second ends 92, 94 to rotatably attach to the upper and lower horizontal mounting assemblies 88, 98.

Figure 2B:
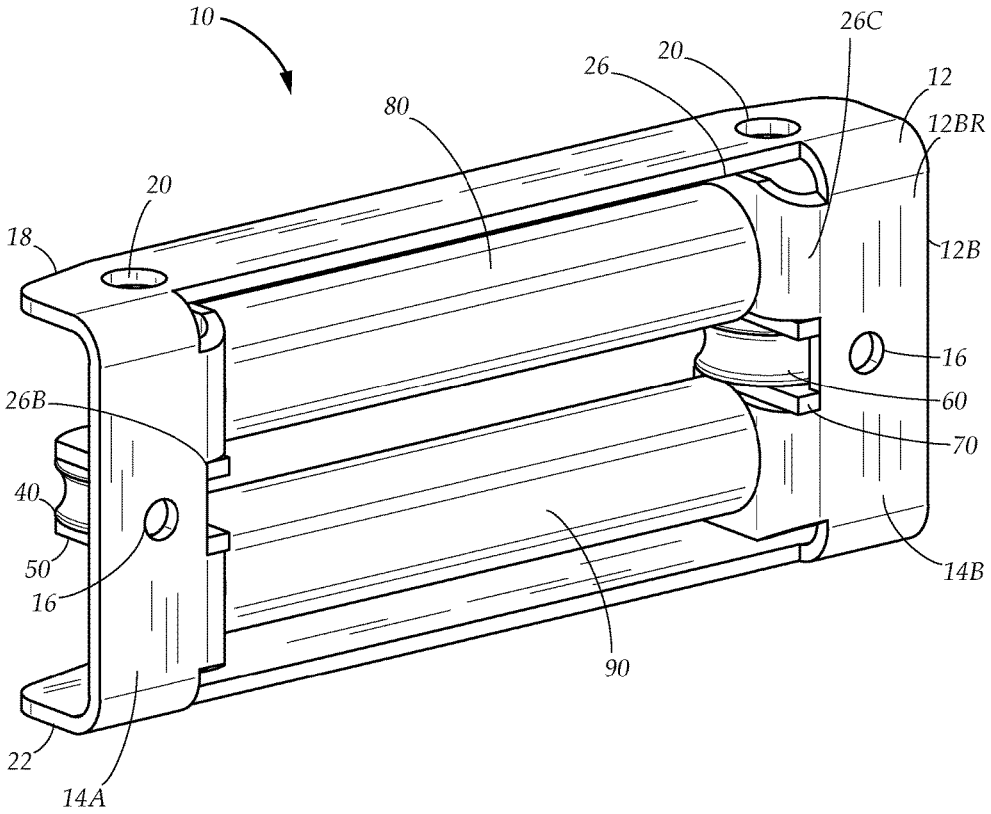
FIG. 2B is a diagrammatic rear perspective view of the fairlead assembly depicting a mounting frame to which the vertical and horizontal rollers are attached, in accordance with an embodiment of the present disclosure.

Turning now to FIG. 2B, while continuing to refer to FIGS. 1 and 2A, the mounting frame 12 may further comprise a back plate 12B. In a preferred embodiment, the back plate 12B may comprise a first mounting portion 14A, a second mounting portion 14B, and a frame opening 26 positioned between the first and second mounting portions 14A, 14B which allows the cable 130 to pass through the fairlead assembly 10. The first and second vertical mounting assemblies 50, 70 and the upper and lower horizontal mounting assemblies 88, 98 are attached to the back plate 12B and project away from the back plate 12B such that the first and second vertical rollers 40, 60 and upper and lower horizontal rollers 80, 90 are held in place in front of the frame opening 26. In certain embodiments, the back plate 12B may be attached to the fairlead mounting point 160 using bolts, screws, welding, or other means, and the back plate 12B may have a plurality of rear mounting holes 16 to facilitate the attachment. In certain embodiments, the mounting frame 12 may further comprise an upper horizontal plate 18 which is positioned above the upper horizontal roller 80 and which projects forwardly away from the back plate 12B. The mounting frame 12 may further comprise a lower horizontal plate 22 positioned below the lower horizontal roller 90 and which projects forwardly and away from the back plate 12B. The upper and lower horizontal plates 18, 22 may serve to protect the horizontal rollers 30 from impacts or direct contact with the ground or other objects. The upper and lower horizontal plates 18, 22 may further comprise a plurality of horizontal mounting holes 20 which allow the fairlead assembly 10 to be attached to the vehicle 150 when the fairlead mounting point 160 is positioned horizontally in relation to the fairlead assembly 10.

Figure 3A:
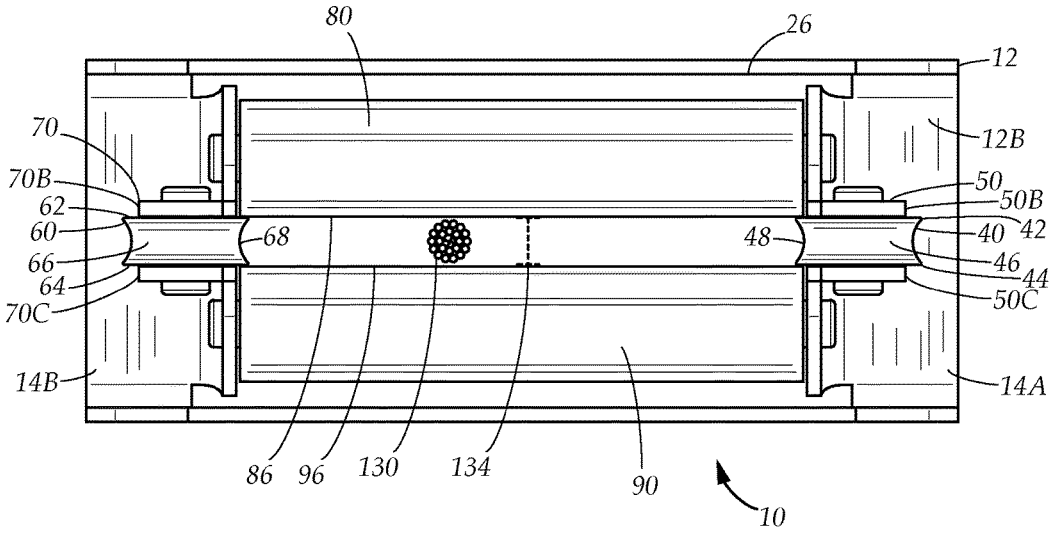
FIG. 3A is a diagrammatic front view of the fairlead assembly, depicting a cable being guided between the horizontal rollers, in accordance with an embodiment of the present disclosure.
Figure 3B:
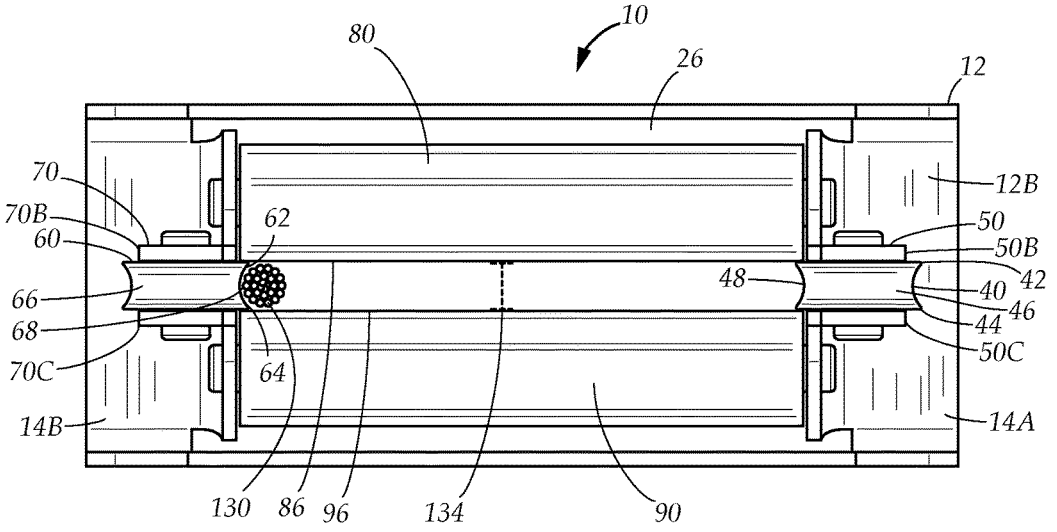
FIG. 3B is a diagrammatic front view of the fairlead assembly, depicting the cable being guided by the second vertical roller, in accordance with an embodiment of the present disclosure.

Turning now to FIGS. 3A-B, while continuing to refer to FIGS. 1 and 2A-B, the upper and lower right brackets 88B, 98B may, in a preferred embodiment, be positioned on the first mounting portion 14A, while the upper and lower left brackets 88C, 98C may be positioned on the second mounting portion 14B. The upper and lower horizontal rollers 80, 90 are rotatably attached to the upper and lower horizontal mounting assemblies 88, 98 respectively, and extend across the frame opening 26 and are separated by the cable guide space 134. The cable guide space 134 may be any height which allows the cable 130 to pass through. In a preferred embodiment, the height of the cable guide space 134 may be substantially the same as, or larger than the diameter of the cable 130.

The first top bracket 50B and the first bottom bracket 50C are positioned on the first mounting portion 14A, while the second top bracket 70B and second bottom bracket 70C are positioned on the second mounting portion 14B. The first and second vertical rollers 40, 60 are positioned to the right and left of the cable guide space 134 respectively. The horizontal movement of the cable 130 within the cable guide space 134 is controlled by the first and second vertical rollers 40, 60, while the vertical movement of the cable 130 is controlled by the upper and lower horizontal rollers 80, 90. As the cable 130 slides horizontally within the cable guide space 134, the cable 130 may contact either the first or second vertical roller 40, 60 depending on the direction of the horizontal movement. Each of the first and second vertical rollers 40, 60 may have a length which is substantially equal to the distance between the upper and lower horizontal rollers 80, 90, thus ensuring that there are no gaps to the right and left of the cable guide space 134 through which the cable 130 may enter and become snagged or pinched. Furthermore, in certain embodiments, the first and second vertical rollers 40, 60 may extend inwardly towards the cable guide space 134, such that the first and second top ends 42, 62 and the first and second bottom ends 44, 64 overlap the upper and lower horizontal rollers 80, 90 respectively.

In a preferred embodiment, the first and second vertical rollers 40, 60 may further comprise a first cable control groove 48 and a second cable control groove 68 respectively.

The first and second cable control grooves 48, 68 may be formed as depressions having a curved aspect, which run along the first vertical roller surface 46 and the second vertical roller surface 66 respectively, in a direction perpendicular to the central axis of each vertical roller. The curved aspect of the first and second cable control grooves 48, 68 allow the cable 130 to be partially retained within the control grooves 46, 68, when the cable 130 would otherwise slide freely across the surface of a standard cylindrical roller. For example, as shown in FIG. 3B, when the cable 130 moves to the left within the cable guide space 134, the cable 130 may slide freely along the upper and lower roller surfaces 86, 96 until the cable 130 contacts the second vertical roller 60. By receiving and partially retaining the cable 130 within the first or second control groove 48, 68, the first and second vertical rollers 40, 60 are able to control both the horizontal and vertical motion of the cable 130.

Figure 4:
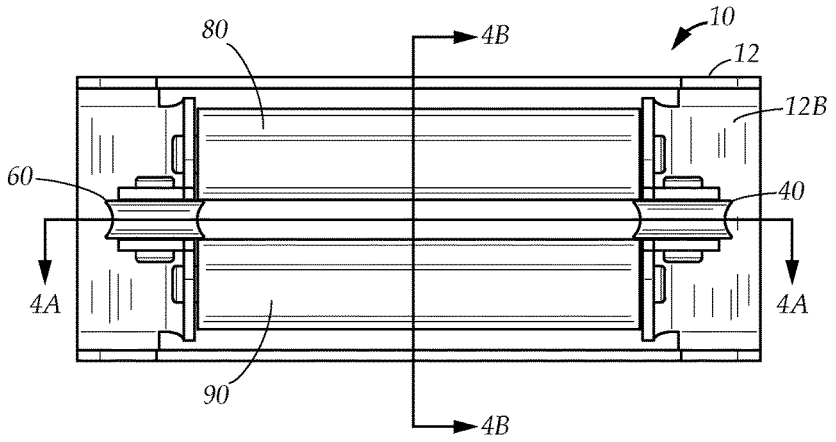
FIG. 4 is a diagrammatic front view of the fairlead assembly, showing a horizontal cutting plane line 4A-4A and a vertical cutting plane line 4B-4B.
Figure 4A:
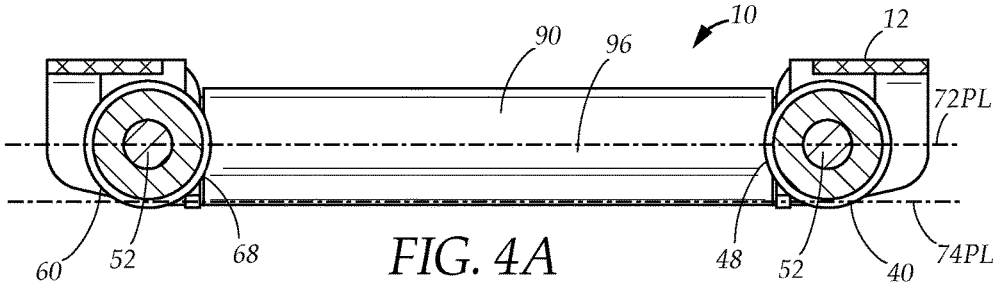
FIG. 4A depicts the fairlead assembly in a sectional view disposed along the plane defined by the horizontal cutting plane line 4A-4A shown in FIG. 4, illustrating the first and second vertical rollers in relation to the lower horizontal roller, in accordance with an embodiment of the present disclosure.
Figure 4B:
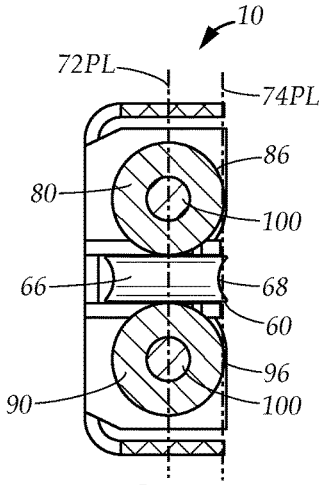
FIG. 4B depicts the fairlead assembly in a sectional view disposed along the plane defined by the vertical cutting plane line 4B-4B shown in FIG. 4, illustrating the upper and lower horizontal rollers in relation to the first vertical roller, in accordance with an embodiment of the present disclosure.

Turning to FIGS. 4, 4A and 4B, while continuing to refer to FIGS. 3A-B, the first and second vertical rollers 40, 60 and the upper and lower horizontal rollers 80, 90 may be substantially coplanar. In a preferred embodiment, the central axes of the first and second vertical rollers 40, 60 as represented by the vertical shafts 52, and the central axes of the upper and lower horizontal rollers 80, 90 as represented by the horizontal shafts 100, may be substantially coplanar with a central vertical plane 72PL which centrally divides the fairlead assembly 10. Furthermore, the first and second vertical rollers 40, 60 and the upper and lower horizontal rollers 80, 90 may each have diameters which are substantially the same, such that the first vertical roller surface 46, second vertical roller surface 66, upper roller surface 86, and lower roller surface 96 are each coplanar with a forward vertical plane 74PL, which runs across the front of the fairlead assembly 10 and is parallel with the central vertical plane 72PL. Note that this example is non-limiting, and the coplanar arrangement between the forward plane line 74PL and the first and second vertical roller surfaces 46, 66 and the upper and lower roller surfaces 86, 96 may be accomplished in an alternate embodiment where the diameters of the first and second vertical rollers 40, 60 differ from the diameters of the upper and lower horizontal rollers 80, 90, and where the central axes of the first and second vertical rollers 40, 60 are not coplanar with the central axes of the upper and lower horizontal rollers 80, 90.

Figure 5:
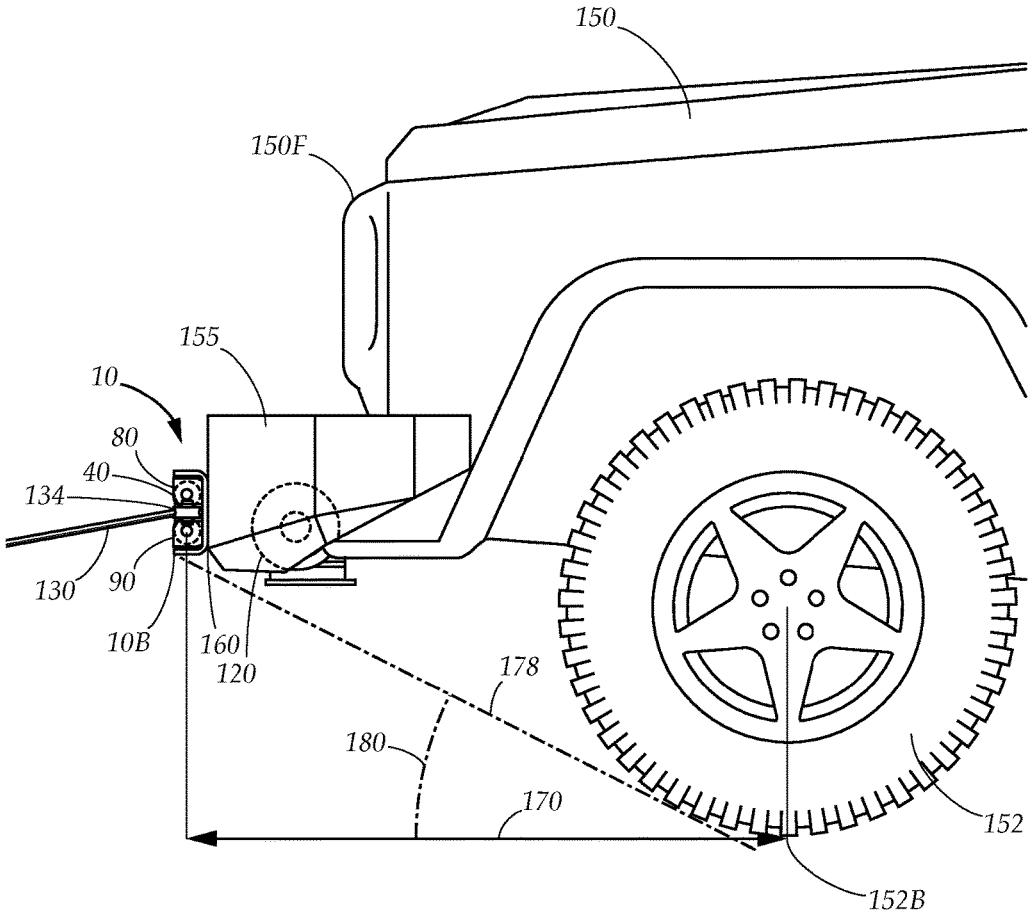
FIG. 5 is a diagrammatic side view of the fairlead assembly mounted onto the bumper of the vehicle in accordance with an embodiment of the present disclosure, depicting the profile of the fairlead assembly and its influence over the approach angle of the vehicle.

Turning now to FIG. 5 while continuing to refer to FIGS. 4A and 4B, the coplanar arrangement of the first and second vertical rollers 40, 60 and the upper and lower horizontal rollers 80, 90, reduces the profile of the fairlead assembly 10 and allows the vehicle 150 to have a greater approach angle 180. The approach angle 180 is defined as the angle between the ground 170, and a clearance line 178 drawn from the point of contact 152B between the front wheel 152 and the ground 170 and the lowest point 10B of the fairlead assembly 10. The approach angle 180 determines the steepest slope which the vehicle 150 can approach and climb without the lowest point 10B of the fairlead assembly 10 contacting the slope and potentially causing damage to the fairlead assembly 10 and/or the vehicle 150. In conventional roller fairleads, the vertical rollers are positioned in front of the horizontal rollers and protrude forwards away from the front 150F of the vehicle 150, resulting in a decreased approach angle.

Figure 6A:
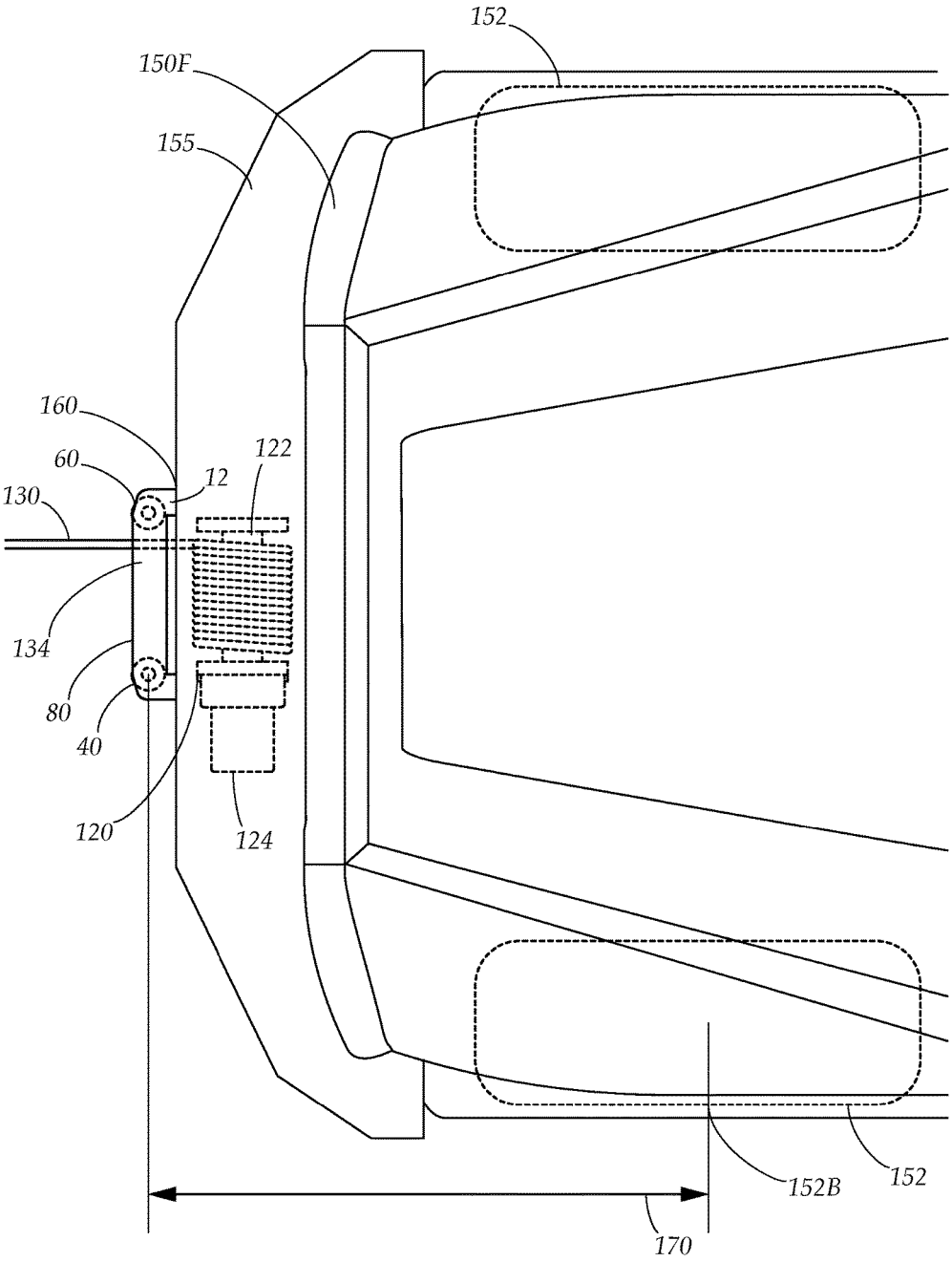
FIG. 6A is a diagrammatic top view depicting the fairlead assembly guiding the cable as the winch executes a straight line pull, in accordance with an embodiment of the present disclosure.
Figure 6B:
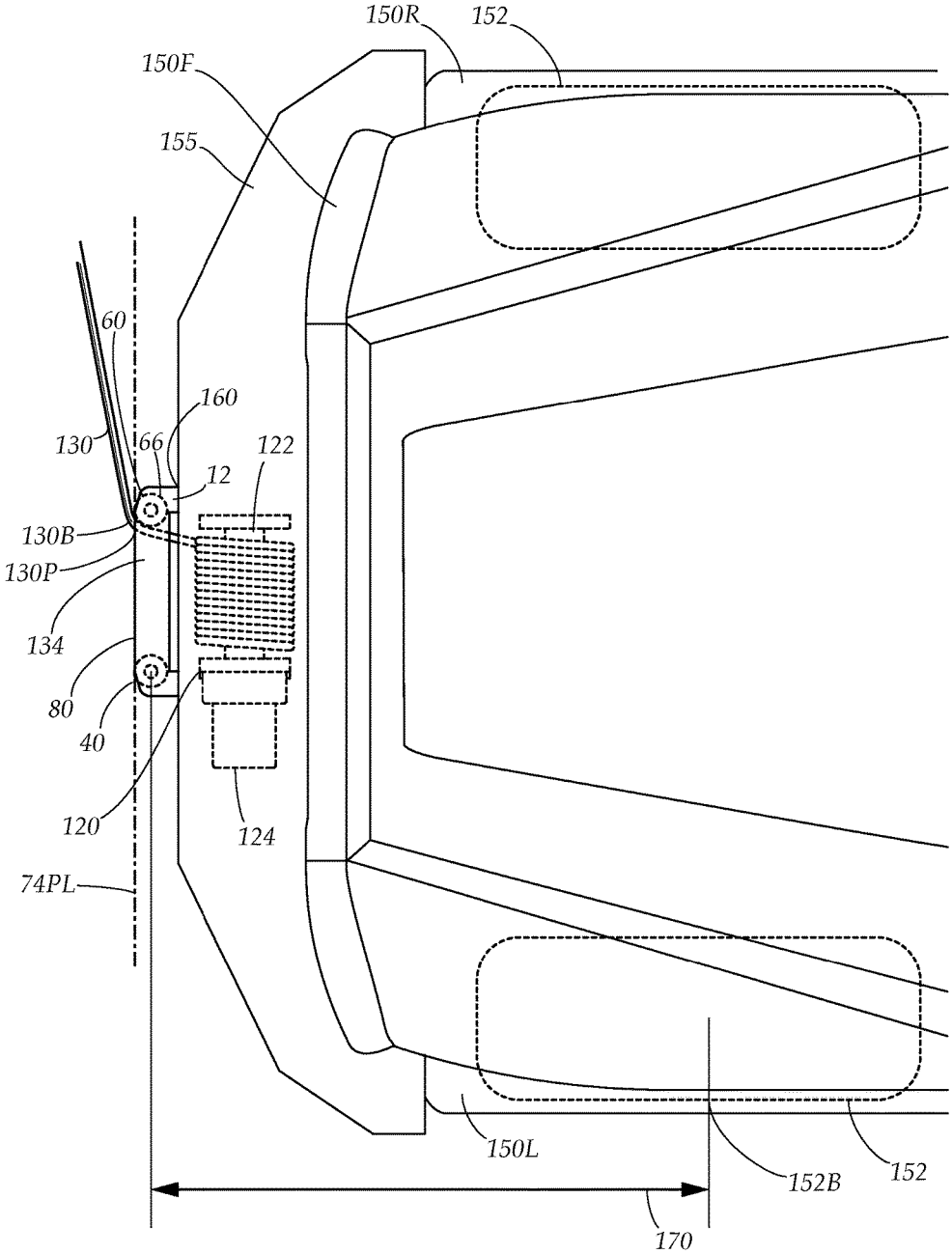
FIG. 6B is a diagrammatic top view depicting the fairlead assembly guiding the cable as the winch executes a sideways pull, in accordance with an embodiment of the present disclosure.

Moving on to FIG. 6A while continuing to refer to FIG. 5, the fairlead assembly 10 is shown guiding the cable 130 as the winch 120 executes a straight line pull where the anchoring point is oriented towards the front 150F of the vehicle 150. The vertical motion of the cable 130 within the cable guide space 134 is controlled by the upper and lower horizontal rollers 80, 90. Turning now to FIG. 6B, while continuing to refer to FIGS. 3B, 4A, 5 and 6A, the winch 120 is shown executing a sideways pull where the anchoring point is oriented towards the right 150R of the vehicle 150. Here, the horizontal motion of the cable 130 within the cable guide space 134 has brought the cable 130 in contact with the second vertical roller 60. The cable 130 bends around the second vertical roller surface 66 towards the right 150F of the vehicle 150, where a cable portion 130B extends beyond the cable guide space 134 and is no longer guided by the upper and lower horizontal rollers 80, 90 but remains in contact with the second vertical roller 60. Furthermore, the cable 130 bends at a bend point 130P which intersects the forward vertical plane 74PL. In a preferred embodiment, the second cable control groove 68 partially retains the cable portion 130B extending beyond the cable guide space 134, such that the second top end 62 and the second bottom end 64 control the vertical upwards and downwards motion of the cable 130 respectively, and allow the cable 130 to remain partially retained within the second cable control groove 68. The first vertical roller 40, along with the first cable control groove 48, the first top end 42, and the first bottom end 44 would perform substantially the same function as described above, when the cable 130 moves horizontally within the cable guide space 134 towards the left 150L of the vehicle 150 and contacts the first vertical roller 60.

The coplanar arrangement of the first and second vertical rollers 40, 60 and the upper and lower horizontal rollers 80, 90 further serves to reduce the amount of force transferred to the mounting frame 12 and the fairlead mounting point 160 when the winch executes the sideways pull, by bringing the fulcrum point (as represented by either the first or second vertical rollers 40, 60) closer to the fairlead mounting point 160.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a fairlead assembly for a vehicle mounted winch. The disclosure is illustrated by example in the drawing figures, and throughout the written description. It should be understood that numerous variations are possible, while adhering to the inventive concept. Such variations are contemplated as being a part of the present disclosure.

What is claimed is:

1. A fairlead assembly for use with a winch and cable mounted on a motor vehicle, the motor vehicle having a front, a side, and a fairlead mounting point disposed on the front of the vehicle to which the fairlead assembly is secured, the winch is adapted to selectively spool in or spool out the cable, the cable is adapted to be attached to an object serving as an anchor point, the fairlead assembly comprising:

an upper horizontal roller and a lower horizontal roller each having a first end, a second end, and a central axis, the upper and lower horizontal rollers are arranged in parallel and are separated by a cable guide space, the cable guide space is adapted to allow the cable to pass therethrough, and the upper and lower horizontal rollers are adapted to control vertical motion of the cable; and a first vertical roller and a second vertical roller each having a top end, a bottom end, and a central axis, the first vertical roller is positioned proximate to the first end of the first and second horizontal rollers and the second roller is positioned proximate to the second end of the first and second horizontal rollers, such that the first and second vertical rollers control horizontal movement of the cable as the cable slides horizontally within the cable guide space, whereby the central axes of the first and second vertical rollers are coplanar with the central axis of; wherein the upper and lower horizontal rollers having a longer length than the first and second vertical rollers.

2. The fairlead assembly as described in claim 1, wherein:

the cable guide space has a height which is equal to a distance between the upper and lower horizontal rollers; and the first and second vertical rollers each have a length which is substantially equal to the height of the cable guide space.

3. The fairlead assembly as described in claim 2, wherein the upper and lower horizontal rollers and the first and second vertical rollers each have a diameter, and the diameters of the upper and lower horizontal rollers are substantially equal to the diameters of the first and second vertical rollers.

4. The fairlead assembly as described in claim 3, wherein the first and second vertical rollers each have a cable control groove adapted to control the vertical movement of the cable as the cable contacts the first or second vertical rollers.

5. The fairlead assembly as described in claim 4, wherein the first vertical roller extends inwardly into the cable guide space past the first end of each of the upper and lower horizontal rollers, and the second vertical roller extends inwardly into the cable guide space past the second end of each of the upper and lower horizontal rollers.

6. The fairlead assembly as described in claim 5, further comprising:

a mounting frame having two pairs of horizontal brackets to which the upper and lower horizontal rollers are rotatably attached, and two pairs of vertical brackets to which the first and second vertical rollers are rotatably attached, the mounting frame is adapted to be attached to the fairlead mounting point.

7. The fairlead assembly as described in claim 6, wherein the mounting frame further has an upper horizontal plate which is positioned above the upper horizontal roller and projects forwardly, and a lower horizontal plate which is positioned below the lower horizontal roller and projects forwardly.

8. A method for performing a sideways pull using a winch and a cable, the winch is adapted to selectively spool in or spool out the cable, the winch is attached to a motor vehicle having a front and a side, the cable is selectively attachable to an anchor point facing the side of the motor vehicle, the method comprising the steps of:

providing a fairlead assembly adapted to be attached to the front of the vehicle, having an upper horizontal roller, a lower horizontal roller, the upper and lower horizontal rollers each have a first end, a second end, a diameter, a surface, and a central axis, the upper and lower horizontal rollers are arranged in parallel and are separated by a cable guide space, a first vertical roller and a second vertical roller each having a diameter, a surface, and a central axis, the first vertical roller is positioned adjacent to the cable guide space proximate to the first end of each of the upper and lower horizontal rollers, the second vertical roller is positioned adjacent to the cable guide space proximate to the second end of each of the upper and lower horizontal rollers, the central axes of the upper and lower horizontal rollers are substantially coplanar with the central axes of the first and second horizontal rollers, and the diameters of the upper and lower horizontal rollers are substantially equal to the diameters of the first and second vertical rollers such that the surfaces of the upper and lower horizontal rollers and the first and second vertical rollers are coplanar with a forward vertical plane;

attaching the cable to the anchor point;

guiding the cable through the cable guide space;

bending the cable towards anchor point and away from the side of the vehicle, and wrapping the cable around the surface of the first or second vertical roller at a bend point intersecting the forward vertical plane; and employing the first or second vertical roller which is in contact with the cable as a fulcrum point, while selectively spooling the cable in or out using; wherein the upper and lower horizontal rollers having a longer length than the first and second vertical rollers.

9. The method as described in claim 8, wherein:

the first and second rollers each further have a cable control groove positioned along the surface of the first and second rollers; and the step of employing the first or second vertical roller which is in contact with the cable as a fulcrum point is followed by the step of limiting vertical movement of the cable by retaining the cable within the cable control groove of the first or second vertical roller.

10. A method for performing a sideways pull using a winch and a cable, the winch is adapted to selectively spool in or spool out the cable, the winch is attached to a motor vehicle having a front and a side, the cable is selectively attachable to a towing object facing the side of the motor vehicle, the method comprising the steps of:

providing a fairlead assembly adapted to be attached to the front of the vehicle, having an upper horizontal roller, a lower horizontal roller, the upper and lower horizontal rollers each have a first end, a second end, a diameter, a surface, and a central axis, the upper and lower horizontal rollers are arranged in parallel and are separated by a cable guide space, a first vertical roller and a second vertical roller each having a diameter, a surface, and a central axis, the first vertical roller is positioned adjacent to the cable guide space proximate to the first end of each of the upper and lower horizontal rollers, the second vertical roller is positioned adjacent to the cable guide space proximate to the second end of each of the upper and lower horizontal rollers, the central axes of the upper and lower horizontal rollers are substantially coplanar with the central axes of the first and second horizontal rollers, and the diameters of the upper and lower horizontal rollers are substantially equal to the diameters of the first and second vertical rollers such that the surfaces of the upper and lower horizontal rollers and the first and second vertical rollers are coplanar with a forward vertical plane;

attaching the cable to the towing object;

guiding the cable through the cable guide space;

bending the cable towards anchor point and away from the side of the vehicle, and wrapping the cable around the surface of the first or second vertical roller at a bend point intersecting the forward vertical plane; and pulling the towing object towards the motor vehicle by spooling in the cable using the winch, and employing the first or second vertical roller which is in contact with; wherein the upper and lower horizontal rollers having a longer length than the first and second vertical rollers.

11. The method as described in claim 10, wherein:

the first and second rollers each further have a cable control groove positioned along the surface of the first and second rollers; and the step of pulling the towing object towards the motor vehicle by spooling in the cable using the winch is followed by the step of limiting vertical movement of the cable by retaining the cable within the cable control groove of the first or second vertical roller which is in contact with the cable.

* * * * *